US006332562B1

(12) United States Patent
Sweeton

(10) Patent No.: US 6,332,562 B1
(45) Date of Patent: Dec. 25, 2001

(54) ERGONOMIC TRIGGER SPRAYER HAVING SIDE SADDLE SUPPORTS

(75) Inventor: Steve L. Sweeton, Lee's Summit, MO (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 09/660,476

(22) Filed: Sep. 12, 2000

(51) Int. Cl.[7] ..... B67D 5/40
(52) U.S. Cl. ..... 222/383.1; 239/333
(58) Field of Search ..... 222/341, 380, 222/383.1; 239/333

(56) References Cited

U.S. PATENT DOCUMENTS

| | | | |
|---|---|---|---|
| D. 409,487 | 5/1999 | Wadsworth et al. | D9/448 |
| D. 409,917 | 5/1999 | Wadsworth et al. | D9/448 |
| D. 409,918 | 5/1999 | Wadsworth et al. | D9/448 |
| D. 420,914 | 2/2000 | Cummings | D9/448 |
| D. 421,388 | 3/2000 | Cummings | D9/448 |
| 4,355,739 | 10/1982 | Vierkotter | 222/134 |
| 4,519,527 * | 5/1985 | Klaeger | 222/383.1 |
| 5,507,437 | 4/1996 | Foster et al. | 239/333 |
| 6,095,377 | 8/2000 | Sweeton et al. | 222/383.1 |
| 6,138,873 * | 10/2000 | Gramola | 222/383.1 |
| 6,182,865 * | 2/2001 | Bunschoten et al. | 222/383.1 |

OTHER PUBLICATIONS

Undated–taken from website, www.take 5net.com. Seven photographs—undated photographs of actual Take 5 Sprayer.

* cited by examiner

*Primary Examiner*—Joseph A. Kaufman
(74) *Attorney, Agent, or Firm*—Dykema Gossett PLLC

(57) ABSTRACT

A trigger actuated sprayer has its shroud provided with laterally extending side saddles having undersurfaces defining supports extending longitudinally and continuously between forward and rearward ends of the shroud to provide for ergonomic supports of the sprayer on the top of the hand of the operator when the sprayer is grasped during use. The lateral outward extent of the side saddles is minimized by the provision of a constricted throat portion of the shroud located beneath side saddles.

15 Claims, 1 Drawing Sheet

ERGONOMIC TRIGGER SPRAYER HAVING SIDE SADDLE SUPPORTS

BACKGROUND OF THE INVENTION

This invention relates generally to a trigger actuated pump sprayer, and more particularly to such a sprayer with an ergonomic design having integral outwardly bulging sides defining side saddles for supporting the container attached to the trigger sprayer securely and conveniently on the top hand of the operator when the sprayer is grasped during use.

Trigger actuated pump sprayers are typically mounted on the neck of a container of liquid product to be dispensed, such as a household product which may be a window cleaner, laundry starch, or the like. More recently, containers of those products are of increased size which when filled with the household liquid can become unmanageable in use due to the weight of the liquid filled container. The container is packaged with the trigger sprayer mounted on the container neck such that in use the operator grasps the container neck as well as at least the closure cap provided for mounting the trigger sprayer to the container, such that the container is supported at the top of the operator's hand by a rearwardly extending shelf defined by a lower rear wall of the pump body or the shroud cover of the pump sprayer. This shelf rests upon the top of the operator's hand at the web of the hand between the thumb and the forefinger while the forefinger or the forefinger and middle finger engage the trigger lever for stroking the pump for dispensing. However with the advent of larger and larger plastic containers filled with liquid household products to be dispensed, the trigger sprayer with only its rearwardly extending support ledge is inadequate in supporting a rather heavy liquid container on the top of the operator's hand for assuring a secure and convenient grip of the sprayer package.

There is a need for an ergonomic improvement of trigger actuated pump sprayers permitting the sprayer package to be more securely and conveniently grasped and held by the operator without slippage and in a manner which reduces fatigue during the spray operation.

SUMMARY OF THE INVENTION

It is an object of the present invention to provide a trigger actuated pump sprayer as more ergonomically capable of supporting the sprayer package on the top of the operator's hand while in use in a manner which is convenient and comfortable for the operator while at the same time reduces fatigue while pumping.

Another object is to provide such a trigger sprayer which is easier and more efficient to mold and mass produce yet which is highly economical and convenient to use.

In carrying out the foregoing general objectives, the shroud cover attached to a standard trigger sprayer pump body has side saddles projecting laterally outwardly of opposing side walls of the shroud to an extent beyond the circular side wall of the closure cap connected to the pump body provided for mounting the pump sprayer to a container of liquid to be sprayed. The side saddles extend longitudinally along the entirety of the shroud side walls and are defined by bent portions of the shroud having the same thickness as the remainder of the shroud bent portions and forming transverse walls for supporting the sprayer on the top of the hand of the operator when the sprayer is grasped during use. And a portion of the shroud cover between the side saddles and a lower free edge of the shroud is constricted inwardly relative to the closure side wall for ergonomically enhancing the support of the sprayer and handling by the operator while also minimizing the lateral outward extent of the side saddles.

A further object of the present invention is to provide such a trigger sprayer in which the constricted portion is defined by inwardly bent sections of at least the sidewalls and have the same thickness as the remainder of the shroud.

A still further object is to provide such a trigger actuated sprayer in which the constricted portion is further defined by an inwardly bent section at the rearward end of the shroud which likewise has the same thickness as the remainder of the shroud.

A still further object is to provide such a trigger sprayer in which the shroud has rearwardly extending portions defining a bottom wall which is coplanar with the transversely extending undersides of the side saddles for providing further support for the sprayer.

Another object is to provide such a trigger sprayer in which the rearwardly extending wall portions have the same thickness as the remainder of the shroud.

Other objects, advantages and novel features of the invention will become more apparent from the following detailed description of the invention when taken in conjunction with the accompanying drawings.

DETAILED DESCRIPTION OF THE INVENTION

Figure 5:
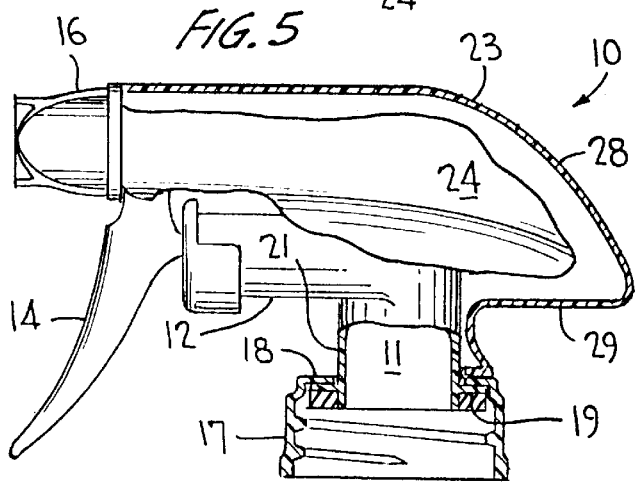
FIG. 5 is a view similar to FIG. 1 with a portion of the sprayer broken away to illustrate further details.

Turning now to the drawings wherein like reference characters refer to like and corresponding parts throughout the several views, the trigger actuated pump sprayer according to the invention is generally designated 10 in the drawings and comprises a pump body 11 as shown, for example, in FIG. 5 which has, inter alia, a pump cylinder 12 in which a pump piston 13 is mounted for reciprocation upon actuation of a trigger lever 14 mounted on the pump body in bearing engagement with the outer end of the piston. The piston is spring biased in a direction outwardly of its bore by a piston return spring (not shown) such that upon each squeeze of the trigger lever the piston is resiliently urged outwardly of its bore, as in any conventional trigger sprayer of this type. Details of the spring biased piston, for example, is disclosed in the commonly owned U.S. Pat. No. 6,095,377, the entirety of which is hereby specifically incorporated by reference.

The pump body has a discharge passage (not shown) terminating in discharge orifice 15 (FIG. 2) formed in a manually rotatable nozzle cap 16 mounted on the nozzle end (not shown) of the pump body. And the pump body has a generally cylindrical closure cap 17 connected thereto for mounting the trigger sprayer to the neck of container C of product to be dispensed upon trigger actuation. As more clearly shown in FIG. 5, the closure has an upper wall defining an inwardly directed annular flange 18 which overlies an outwardly directed annular flange 19 at the lower end of a tubular portion 21 of the pump body. The closure cap may be internally threaded for engagement with the external threads on the container neck (not shown). And a dip tube 22 (FIG. 2) is suspended from an inlet passage (not shown) of the pump body into the container for conducting liquid into the pump chamber on each suction stroke of the piston as in a manner well known in this art.

The trigger sprayer also has a shroud cover 23 overlying the pump body and connected thereto on assembly in any normal manner known in this art. The shroud has a pair of opposing sidewalls 24, 25 terminating at a forward end adjacent nozzle cap 16, and having a lower edge 26 juxtaposed to the top wall of closure cap 17.

Figure 3:
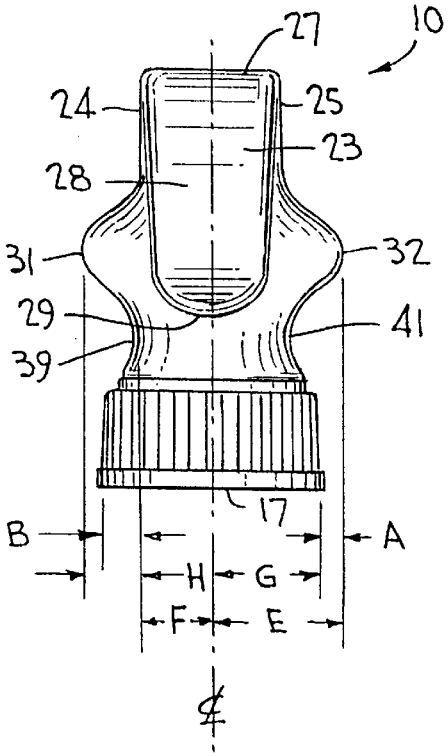
FIG. 3 is a rear elevational view of the FIG. 1 trigger sprayer.
Figure 4:
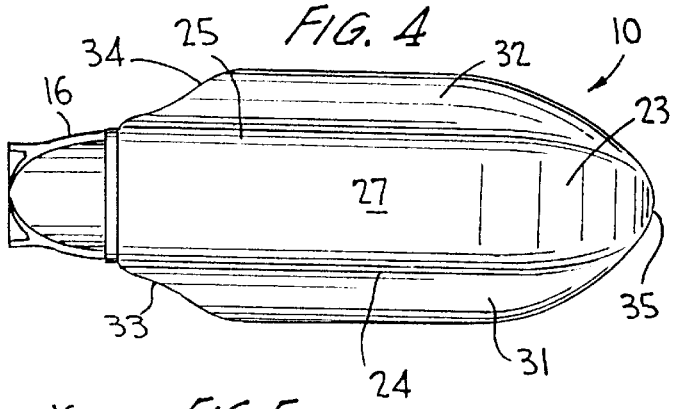
FIG. 4 is a top plan view of a trigger sprayer of FIG. 1.

The shroud has a top wall 27 which may be flat and a hump backed rearward end 28 intersecting a bottom wall 29 which extends rearwardly of closure 17 and, as more clearly in shown in FIG. 3, may be slightly convex. Specifically in accordance with the invention, the shroud cover has protrusions defining side saddles 31, 32 integrally formed with the respective side walls 24, 25. As seen especially in FIG. 1, the side saddles extend longitudinally-and continuously between forward edges 33, 34 of the shroud and rearward terminal end 35 of the shroud. Likewise the side saddles extend laterally outwardly of the circular side wall of closure cap 17 each a distance A as shown in FIG. 3. The undersurfaces 36, 37 of the side saddles define ergonomic supports resting on the top of the thumb and forefinger of the operator as will be more fully described hereinafter. The undersurfaces 36, 37 are smoothly merged with bottom wall 29 of the shroud so as to be essentially coplanar therewith. (See FIGS. 1 and 3).

Figure 2:
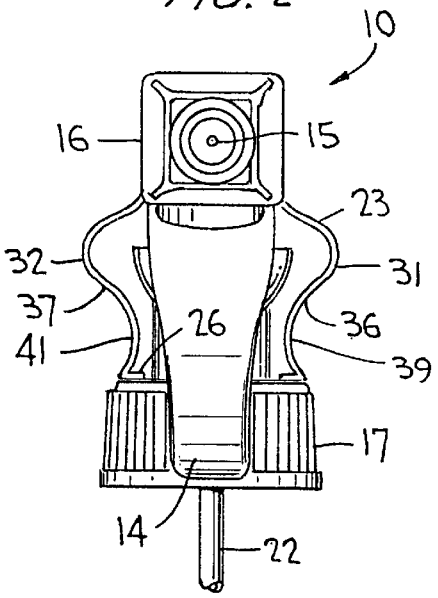
FIG. 2 is a front elevational view of the trigger sprayer of FIG. 1.

As seen in especially FIG. 2, the protrusions forming the side saddles are defined by bent portions of the shroud and have the same thickness as the remainder of the shroud which is essentially shown in FIG. 5.

Figure 1:
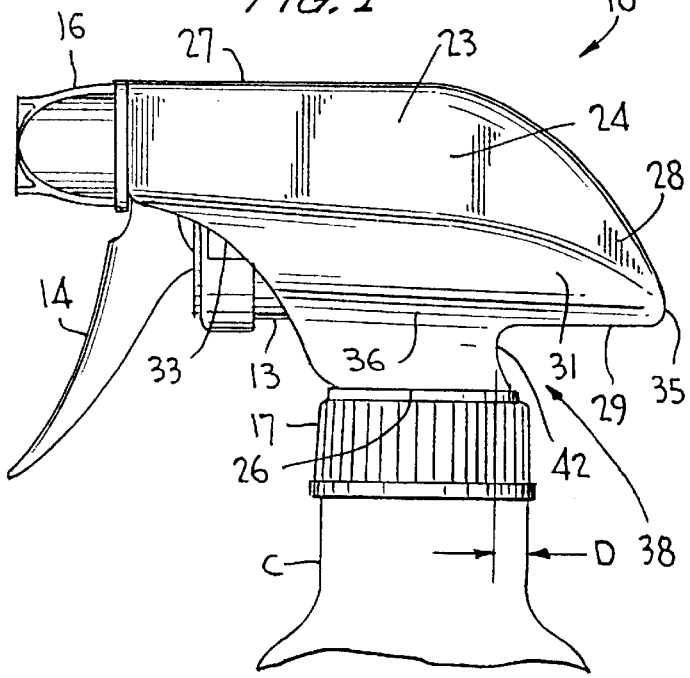
FIG. 1 is a left side elevational view of a trigger sprayer according to the invention.

The shroud has a constricted throat portion 38 formed between side saddles 31, 32 and lower edge 26 of the shroud. The constricted portion is defined by inwardly bent sections 39, 41 of side walls 24, 25. (See FIGS. 2 and 3). The constricted portion is further defined by inwardly bent section 42 (FIG. 1) at the rearward end of the shroud adjacent bottom wall 29. As shown in FIG. 3, each inwardly bent section 39, 41 is spaced inwardly of the circular side wall of the closure cap a distance B. And, as shown in FIG. 1, inwardly bent section 42 is spaced inwardly of the circular side wall of the closure cap a distance D.

Referring to FIG. 3, it can be seen that the lateral extent of each side saddle from 1I the longitudinal centerline of the sprayer is a distance E which equals A+G, where G is the radius of the closure cap. More importantly, distance F, which is the distance between the sprayer centerline and each side wall constriction 39, 41, is less than distance G.

In addition to the improved ergonomics provided by the invention, the size of the sprayer is minimized while providing improved ergonomics. Thus E is minimized while retaining the effective support offered by each distance H which is equal to E minus F. In providing inwardly bent sections 39, 41 adequate side supports measured by distances H can be readily achieved.

In use the operator grasps the spray package with the palm of his hand essentially surrounding the closure and bottle neck such that the web of the hand between the thumb and forefinger underlie bottom wall 29. The thumb also extends beneath undersurface 36 of side saddle 31 while the forefinger extends beneath undersurface 37 of side saddle 32. The thumb, forefinger and hand web likewise grip about constricted portion 38 comprising inwardly bent sections 39, 41, 42. The operator can simply and conveniently manipulate the trigger lever by the forefinger or by the forefinger and the middle finger by pulling the trigger to actuate the pump. While the pump sprayer is held as aforedescribed, the liquid container to which the sprayer is attached is suspended and its weight is conveniently carried by the operator's hand without fatigue or discomfort during the spraying operation. The side saddles according to the invention provide simple yet highly efficient ergonomic side supports for the sprayer package which may likewise have a bottom wall 29 support which normally rests against the top of the operator's hand web.

Since the side saddles and constricted throat portion are formed by simple bent portions during molding and since the entirety of the shroud is of uniform thickness, the same can be readily molded of plastic material with minimal tooling change.

Obviously, many other modifications and variations of the present invention are made possible in the light of the above teachings. It is therefore to be understood that within the scope of the appended claims the invention may be practiced otherwise than as specifically described.

What is claimed is:

1. A trigger actuated pump sprayer comprising, a longitudinally extending pump body having a closure cap for mounting the sprayer to a container of product to be sprayed, the cap having a circular side wall with a predetermined diameter, a nozzle cap rotatably mounted on a front nozzle end of the pump body, a trigger lever pivotally mounted on said pump body for actuation of a pump piston received within a pump cylinder of said pump body for reciprocation upon trigger actuation, a shroud cover connected to said pump body, the shroud cover having a top wall and a pair of spaced parallel side walls, a curved rearward wall merging with said top and side walls, a longitudinally extending bottom wall at a lower end of said side walls projecting rearwardly of said closure cap, and a lower edge of said shroud being juxtaposed to a top confronting wall of the closure, the improvement wherein said shroud has integrally formed side saddles extending laterally outwardly of the closure cap sidewalls to define lateral supports for resting the sprayer on top of an operator's hand when holding the sprayer during use, the side saddles extending continuously between forward edges of the shroud adjacent the trigger lever and a rearward terminal end of said bottom wall, the side saddles having bottom walls for supporting the sprayer on the operator's hand, the bottom walls lying essentially parallel with said rearwardly projecting bottom wall of said shroud, and wherein portions of the sidewalls beneath said side saddles are inwardly constricted relative to said lower edge of said shroud to improve upon ease of gripping and holding of the sprayer by the operator and to minimize the lateral extent of the side saddles while retaining the support provided by the bottom walls of the side saddles.

2. The pump sprayer according to claim 1, wherein a lower section of the shroud beneath the side saddles and at a rearward end of the sprayer is inwardly constricted to further improve upon the ease of gripping and holding of the sprayer by the operator and to effectively increase the size of the rearwardly projecting bottom wall.

3. A trigger actuated pump sprayer comprising, a pump body having a pump cylinder receiving a reciprocable pump piston for discharging liquid product through a discharge passage upon piston reciprocation by actuation of a trigger lever pivotally connected to the body, a closure cap having a top wall and a cylindrical side wall and being connected to the body for mounting the sprayer to a container of liquid to be dispensed, a shroud cover attached to said body and having a lower edge juxtaposed to the top wall of the closure, the improvement wherein the shroud has a pair of opposing sidewalls respectively formed with longitudinally extending, laterally projecting protrusions defining side saddles having transverse walls extending laterally outwardly beyond the sidewall of the closure for supporting the sprayer on the top of the hand of the operator when the sprayer is grasped during use, said protrusions being defined by bent portions of the shroud of the same thickness as the remainder of the shroud, and said shroud having a portion located between said side saddles and said lower edge which is constricted inwardly relative to the closure sidewall for enhancing the support of the sprayer on the operator's hand.

4. The pump sprayer according to claim 3, wherein the constricted portion is defined by inwardly bent sections of the side walls having the same thickness as the remainder of the shroud.

5. The pump sprayer according to claim 4, wherein the constricted portion is further defined by an inwardly bent section at the rear of the shroud having the same thickness as the remainder of the shroud.

6. The pump sprayer according to claim 3, wherein said shroud has a rearwardly extending portion defining a bottom wall essentially parallel with said transverse walls of said side saddles for further supporting the sprayer on the top of the hand of the operator when the sprayer is grasped during use.

7. The pump sprayer according to claim 6, wherein the bottom wall has the same thickness as the remainder of the shroud.

8. An ergonomic trigger sprayer comprising, a longitudinally extending sprayer body having a closure cap for mounting the sprayer to a container of product to be sprayed, the cap having a circular side wall with a predetermined diameter, a nozzle cap rotatably mounted on a front nozzle end of the sprayer body, the trigger sprayer having a pivotally mounted trigger lever for effecting the discharge of product upon trigger actuation, a shroud cover connected to said sprayer body, the shroud cover having a top wall and a pair of spaced parallel side walls, a curved rearward wall merging with said top and side walls, a longitudinally extending bottom wall at a lower end of said side walls projecting rearwardly of said closure cap, and said closure being located at a lower end of said shroud, the improvement wherein said shroud has integrally formed side saddles extending laterally outwardly of the closure cap sidewalls to define lateral supports for resting the sprayer on top of an operator's hand when holding the sprayer during use, the side saddles extending continuously between a forward end of the shroud adjacent the trigger lever and a rearward terminal end of said bottom wall, the side saddles having bottom walls for supporting the sprayer on the operator's hand, the bottom walls lying essentially parallel with said rearwardly projecting bottom wall of said shroud, and wherein portions of the sidewalls beneath said side saddles are inwardly constricted relative to said circular side wall of said cap to improve upon ease of gripping and holding of the sprayer by the operator and to minimize the lateral extent of the side saddles while retaining the support provided by the bottom walls of the side saddles.

9. The ergonomic trigger sprayer according to claim 8, wherein a lower section of the shroud beneath the side saddles and at a rearward end of the sprayer are inwardly constricted to further improve upon the ease of gripping and holding of the sprayer by the operator and to effectively increase the size of the rearwardly projecting bottom wall.

10. An ergonomic trigger sprayer comprising, a longitudinally extending sprayer body having a closure cap for mounting the sprayer to a container of product to be sprayed, the cap having a cylindrical side wall with a predetermined diameter, a nozzle cap rotatably mounted on a front nozzle end of the sprayer body, the trigger sprayer having a pivotally mounted trigger lever for effecting the discharge of product upon trigger actuation, a shroud cover connected to said sprayer body, the shroud cover having a top wall and a pair of spaced parallel side walls, a curved rearward wall merging with said top and side walls, a longitudinally extending bottom wall at a lower end of said side walls projecting rearwardly of said closure cap, and said closure being located at a lower end of said shroud, the improvement wherein said shroud has integrally formed side saddles extending laterally outwardly of the closure cap sidewalls to define lateral supports for resting the sprayer on top of an operator's hand when holding the sprayer during use, the side saddles extending continuously between a forward end of the shroud adjacent the trigger lever and a rearward terminal end of said bottom wall, the side saddles having bottom walls for supporting the sprayer on the operator's hand, the bottom walls lying essentially parallel with said rearwardly projecting bottom wall of said shroud, and wherein a lower section of the shroud beneath the side saddles-and at a rearward end of the sprayer is inwardly constricted relative to seal cap cylindrical sidewall to effectively increase the size of the rearwardly projecting bottom wall and to improve upon ease of gripping and holding the sprayer by the operator.

11. An ergonomic trigger sprayer comprising, a sprayer body having means for discharging liquid product through a discharge passage upon actuation of a pivotable trigger lever of the sprayer, the sprayer including a closure cap having a top wall and a cylindrical sidewall for mounting the sprayer to a container of liquid to be dispensed, a shroud cover attached to said body, and the closure being located at the lower end of the shroud, the improvement wherein the shroud has a pair of opposing sidewalls respectively formed with longitudinally extending, laterally projecting protrusions defining side saddles having transverse walls extending laterally outwardly beyond the sidewall of the closure for supporting the sprayer on the top of the hand of the operator when the sprayer is grasped during use, said protrusions being defined by bent portions of the shroud of the same thickness as the remainder of the shroud, and said shroud having a portion located beneath said side saddles which is constricted inwardly relative to the closure sidewall for enhancing the support of the sprayer on the operator's hand.

12. The ergonomic trigger sprayer according to claim 11, wherein the constricted portion is defined by inwardly bent sections of the side walls having the same thickness as the remainder of the shroud.

13. The ergonomic trigger sprayer according to claim 12, wherein the constricted portion is further defined by an inwardly bent section at the rear of the shroud having the same thickness as the remainder of the shroud.

14. The ergonomic trigger sprayer according to claim 11, wherein said shroud has a rearwardly extending portion defining a bottom wall essentially parallel with said transverse walls of said side saddles for further supporting the sprayer on the top of the hand of the operator when the sprayer is grasped during use.

15. The ergonomic trigger sprayer according to claim 14, wherein the bottom wall has the same thickness as the remainder of the shroud.

US 6,332,562 B1
7 8

* * * * *